US008820006B2

(12) United States Patent
Zook

(10) Patent No.: US 8,820,006 B2
(45) Date of Patent: Sep. 2, 2014

(54) HUB AND STRUT CONNECTION FOR CONSTRUCTING A GEODESIC DOME

(76) Inventor: Brian Paul Zook, Casper, WY (US)

( * ) Notice: Subject to any disclaimer, the term of this patent is extended or adjusted under 35 U.S.C. 154(b) by 0 days.

(21) Appl. No.: 13/432,013

(22) Filed: Mar. 28, 2012

(65) Prior Publication Data

US 2012/0247035 A1 Oct. 4, 2012

Related U.S. Application Data

(60) Provisional application No. 61/469,043, filed on Mar. 29, 2011.

(51) Int. Cl.
*E04B 7/08* (2006.01)
*E04B 1/32* (2006.01)

(52) U.S. Cl.
CPC ..... *E04B 1/3211* (2013.01)
USPC ..... 52/81.3; 52/655.1

(58) Field of Classification Search
USPC ..... 52/80.1–81.6, 655.1, 655.9, DIG. 10
See application file for complete search history.

(56) References Cited

U.S. PATENT DOCUMENTS

| | | | | | |
|---|---|---|---|---|---|
| 3,049,785 | A * | 8/1962 | Chiado et al. | 249/189 |
| 3,635,509 | A * | 1/1972 | Birkemeier et al. | 403/173 |
| 4,247,218 | A * | 1/1981 | Jeannin | 403/217 |
| 4,357,118 | A * | 11/1982 | Murray | 403/172 |
| 4,534,672 | A * | 8/1985 | Christian, III | 403/172 |
| 4,566,818 | A * | 1/1986 | Schwartz et al. | 403/172 |
| 4,720,947 | A * | 1/1988 | Yacaboni | 52/81.3 |
| 4,904,108 | A * | 2/1990 | Wendel | 403/173 |
| 5,224,320 | A * | 7/1993 | Mai | 52/648.1 |
| 6,708,455 | B1 * | 3/2004 | Niiduma | 52/81.2 |
| 6,748,712 | B2 * | 6/2004 | Likozar et al. | 52/506.07 |
| 7,152,384 | B1 * | 12/2006 | McCarty | 52/639 |
| 7,434,359 | B2 * | 10/2008 | Geiger | 52/81.3 |
| 7,802,404 | B2 * | 9/2010 | Wolfram | 52/81.3 |
| 7,882,660 | B2 * | 2/2011 | Kitagawa | 52/81.1 |
| 8,347,561 | B2 * | 1/2013 | Howe | 52/81.3 |

* cited by examiner

*Primary Examiner* — William Gilbert
*Assistant Examiner* — Gisele Ford

(57) ABSTRACT

The present invention relates generally to geodesic dome structures. More particularly, the present invention relates to a hub and strut connection for a geodesic dome structure and method for making same. The apparatus described herein provides a unique design for a geodesic dome utilizing materials that are affordable and readily available throughout much of the world for the construction and connection of hubs and struts.

1 Claim, 26 Drawing Sheets

HUB AND STRUT CONNECTION FOR CONSTRUCTING A GEODESIC DOME

CROSS-REFERENCE TO RELATED APPLICATIONS

Provisional Application No. 61/469,043 filed Mar. 29, 2011.

STATEMENT REGARDING FEDERALLY SPONSORED RESEARCH OR DEVELOPMENT

N/A

THE NAMES OF THE PARTIES TO A JOINT RESEARCH AGREEMENT

N/A

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

N/A

BACKGROUND OF THE INVENTION

1. Field of the Invention

The present invention relates generally to geodesic dome structures. More particularly, the present invention relates to a hub and strut connection for a geodesic dome structure.

2. Description of Related Art

Related art may be found in, but not necessarily limited to, the following US classifications: 52/81, 52/81.3, 52/81.3, 52/82, 52/586, 403/172, 403/218, and 446/97.

BRIEF SUMMARY OF THE INVENTION

The apparatus described herein provides a unique design for a geodesic dome utilizing materials that are affordable and readily available throughout much of the world for the construction and connection of hubs and struts.

In the preferred embodiment, hubs are formed from rebar and constructed by placing precisely cut rebar sections in specially designed jigs and welding the rebar sections together. The prongs of the rebar hubs are inserted into cement/concrete filled notched struts and wired into place. Once the cement/concrete hardens, the hub and strut connections provide compressive and tensile strength to the combination. Each hub and strut combination is then enclosed within a uniquely designed form that is filled with cement/concrete. The form is removed after the cement/concrete hardens thereby providing additional strength to the structure. The uniqueness of this design is the connection of the rebar hubs with struts using affordable and available materials.

It is the intention that the invention described herein be used in regions that have suffered a natural disaster and are in need of humanitarian aid. The apparatus may be built or repaired with materials that are salvageable from destroyed structures or found in nature.

BRIEF DESCRIPTION OF THE SEVERAL VIEWS OF THE DRAWINGS

A preferred embodiment of the present invention is described in detail below with reference to the attached drawing figures, wherein.

DETAILED DESCRIPTION OF THE INVENTION

The embodiments discussed herein are merely illustrative of specific manners in which to make and use the invention and are not to be interpreted as limiting the scope of the instant invention. Referring to the above listed drawings in detail:

Hubs.

Figure 1:
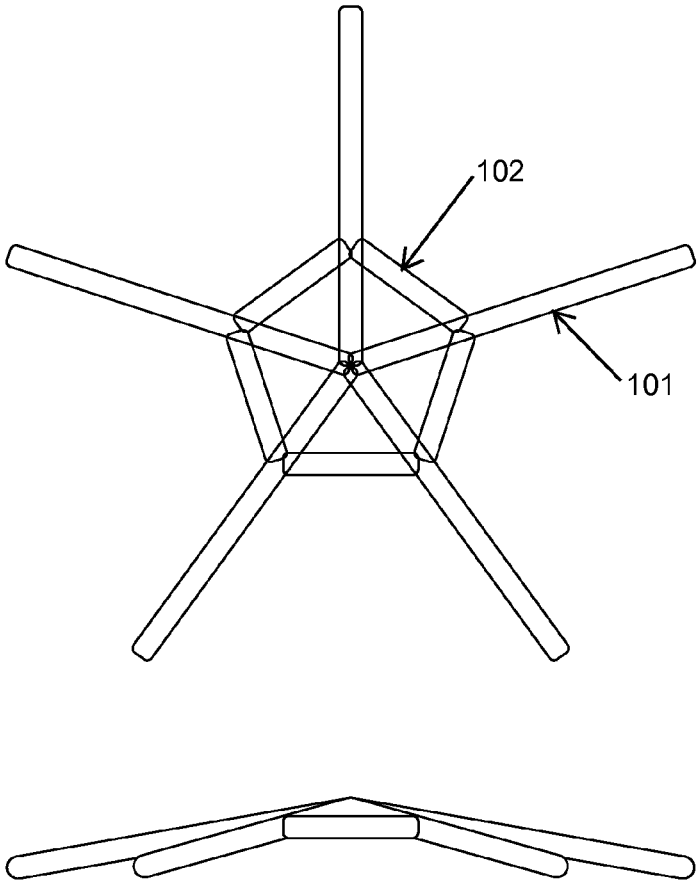
FIG. 1 illustrates a view of pentagon hub.
Figure 2:
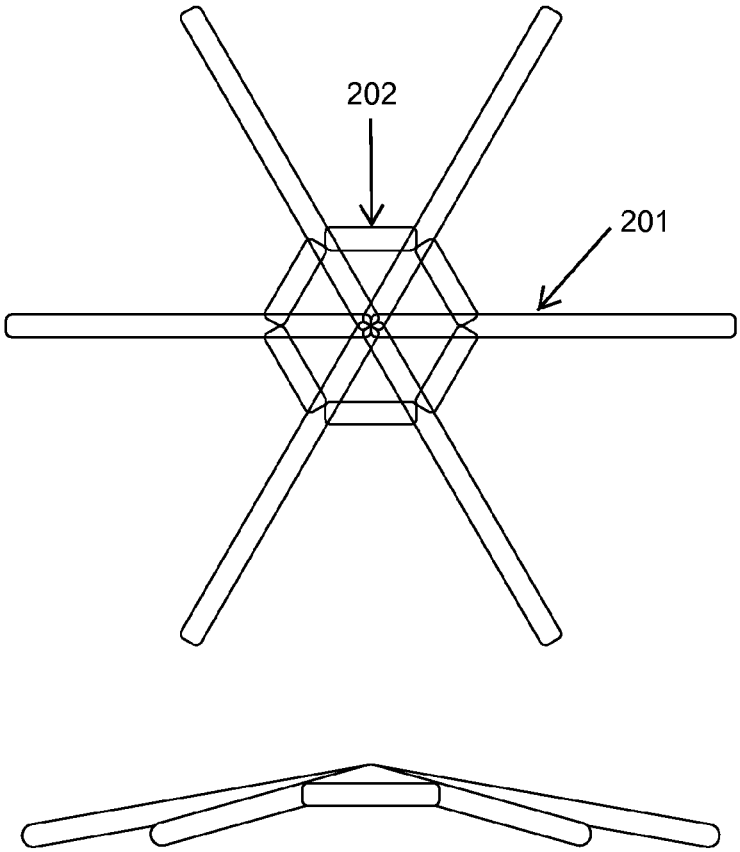
FIG. 2 illustrates a view of hexagon hub.
Figure 3:
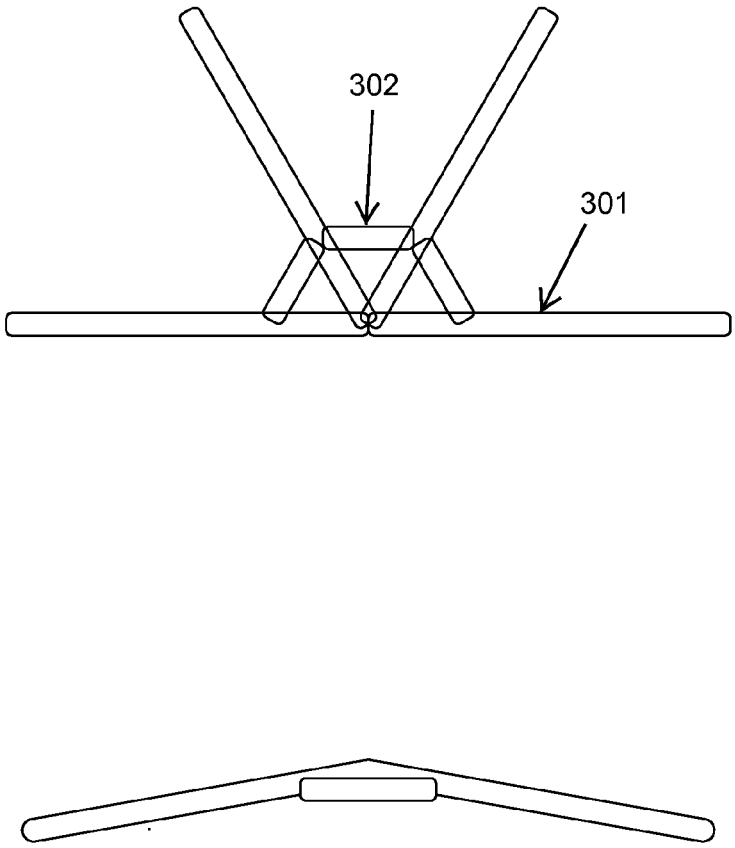
FIG. 3 illustrates a view of ½ hexagon hub.
Figure 4:
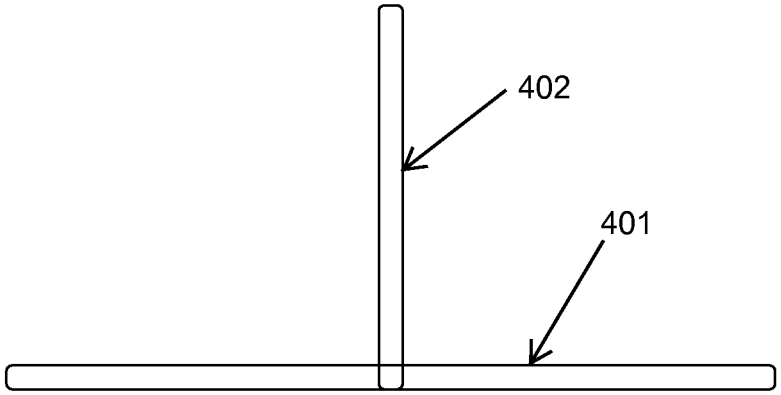
FIG. 4 illustrates a view of entry midway T-hub.
Figure 5:
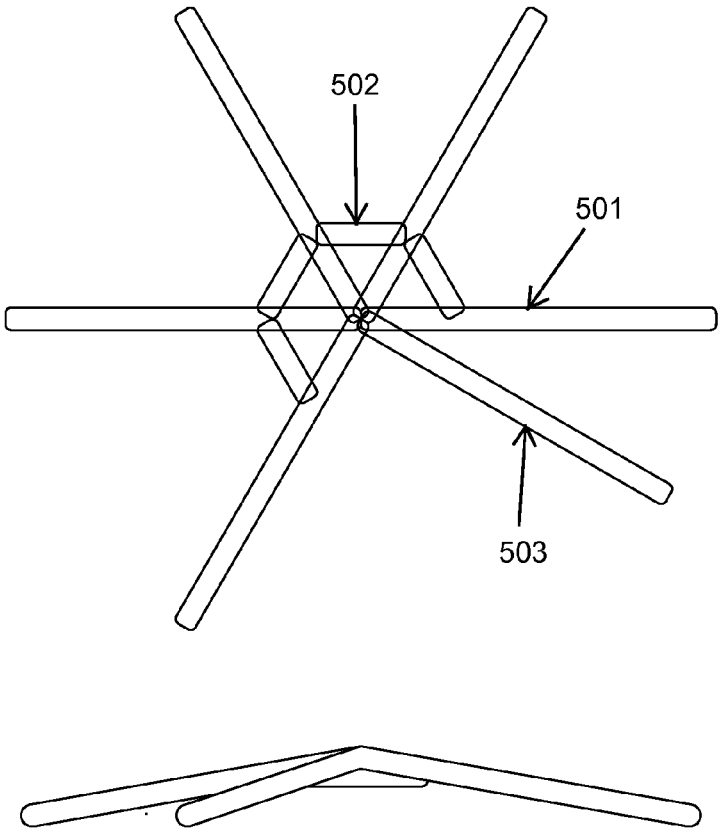
FIG. 5 illustrates a view of entry top hub (right).
Figure 6:
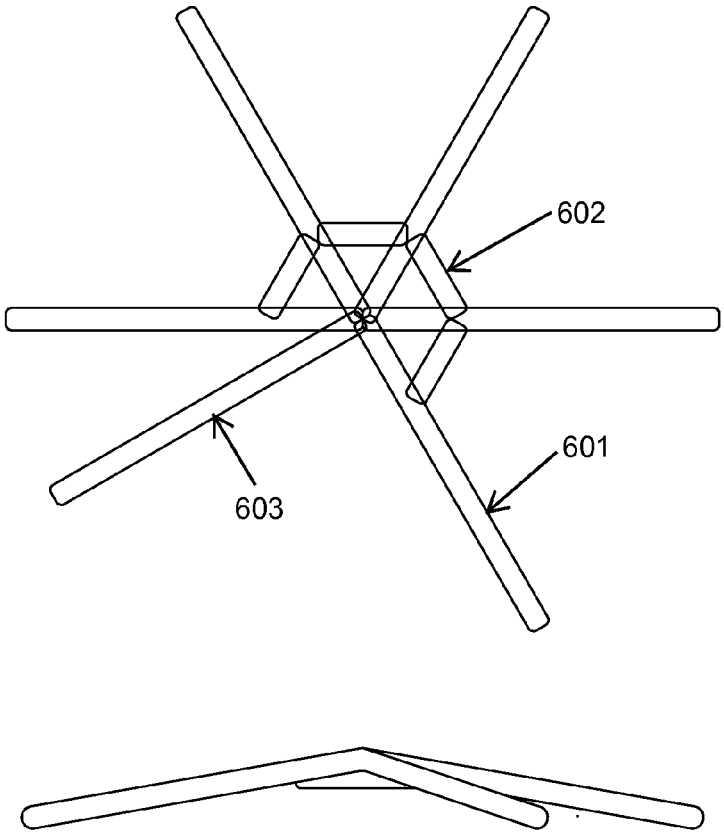
FIG. 6 illustrates a view of entry top hub (left).
Figure 7:
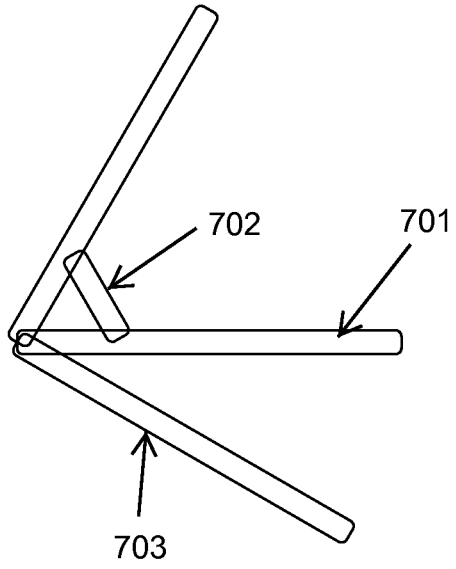
FIG. 7 illustrates a view of entry bottom hub (right).
Figure 7:
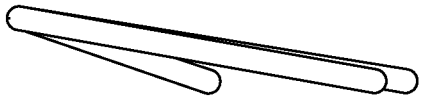
Figure 8:
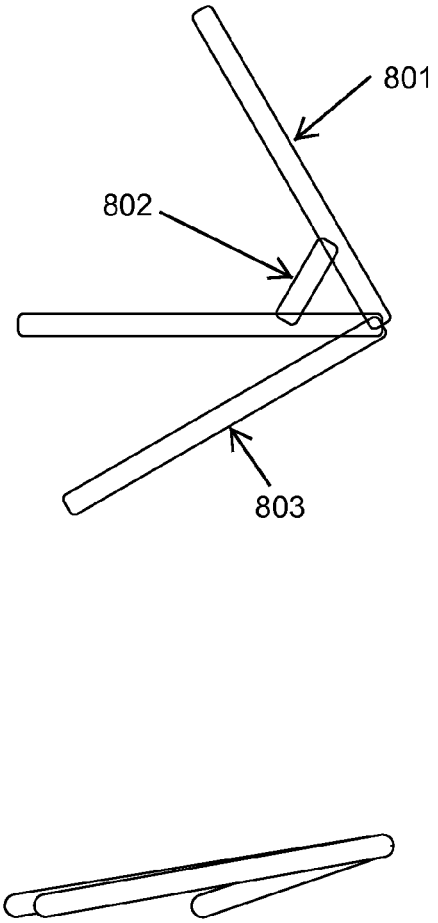
FIG. 8 illustrates a view of entry bottom hub (left).
Figure 19:
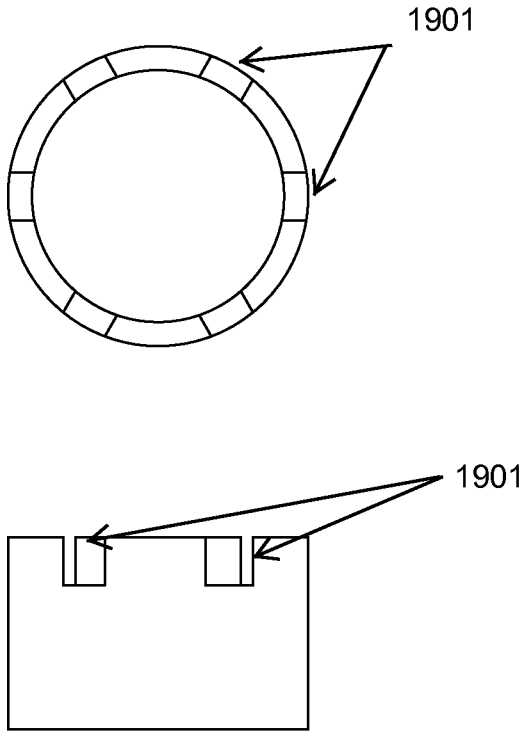
FIG. 19 illustrates a view of hexagon jig.
Figure 20:
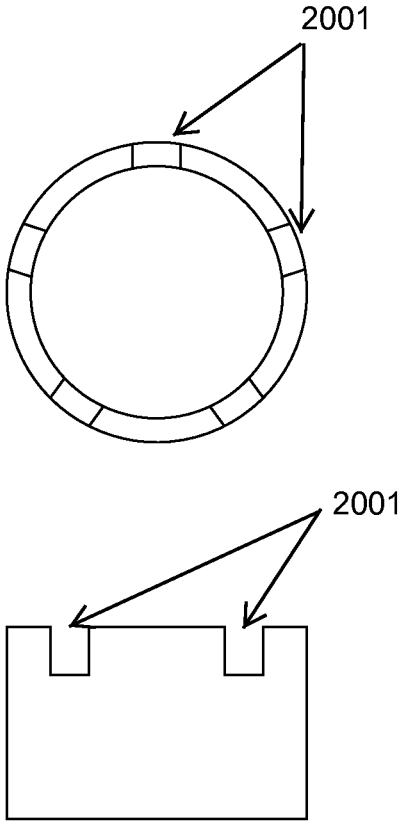
FIG. 20 illustrates a view of pentagon jig.
Figure 21:
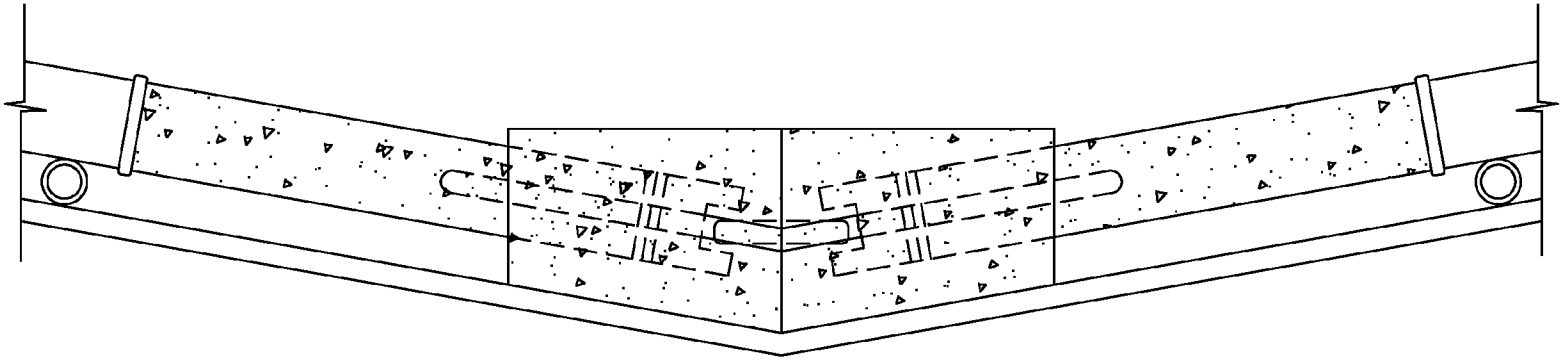
FIG. 21 illustrates a view of hub section.
Figure 22:
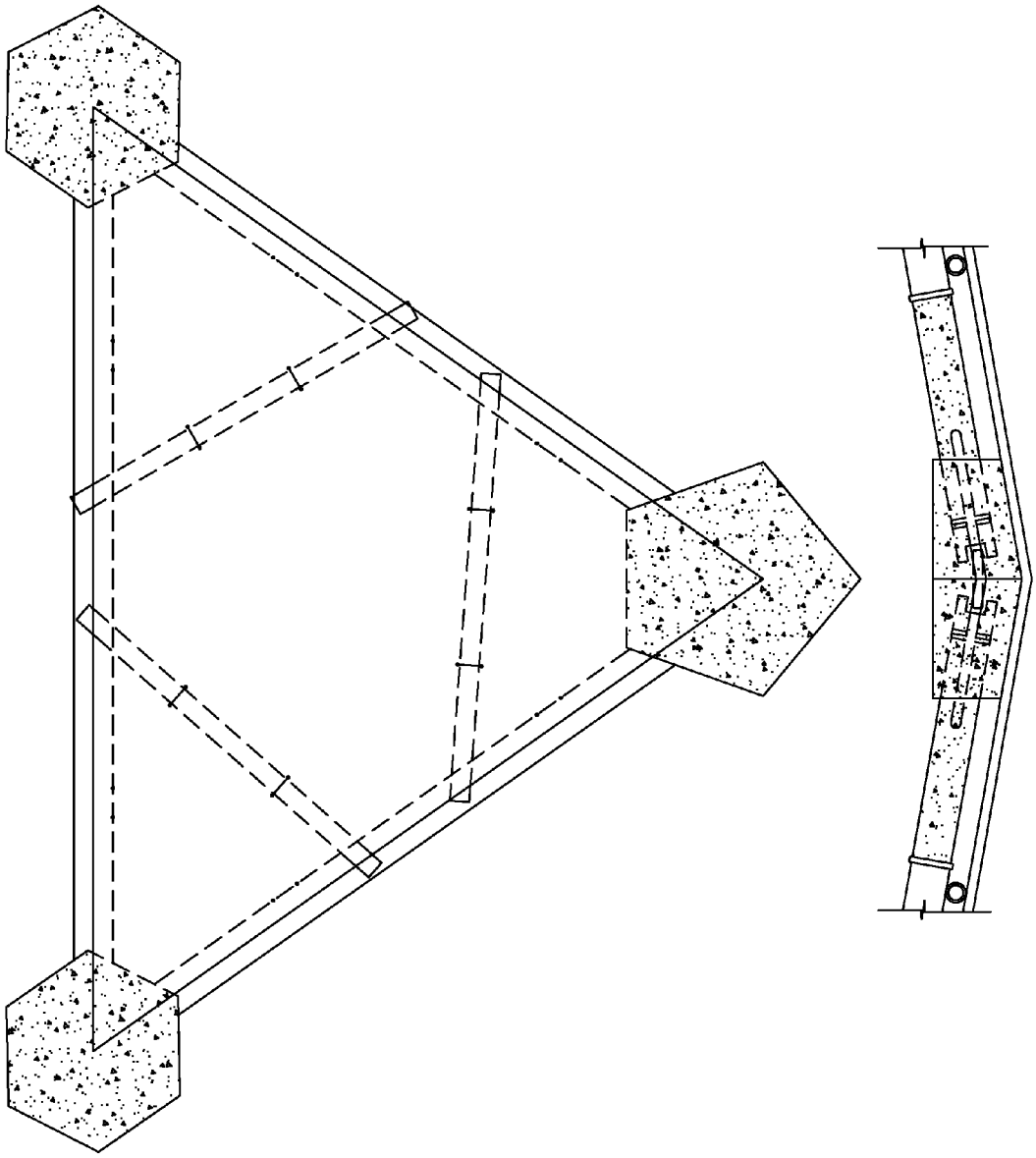
FIG. 22 illustrates a view of "AAB" panel attachment to struts.
Figure 23:
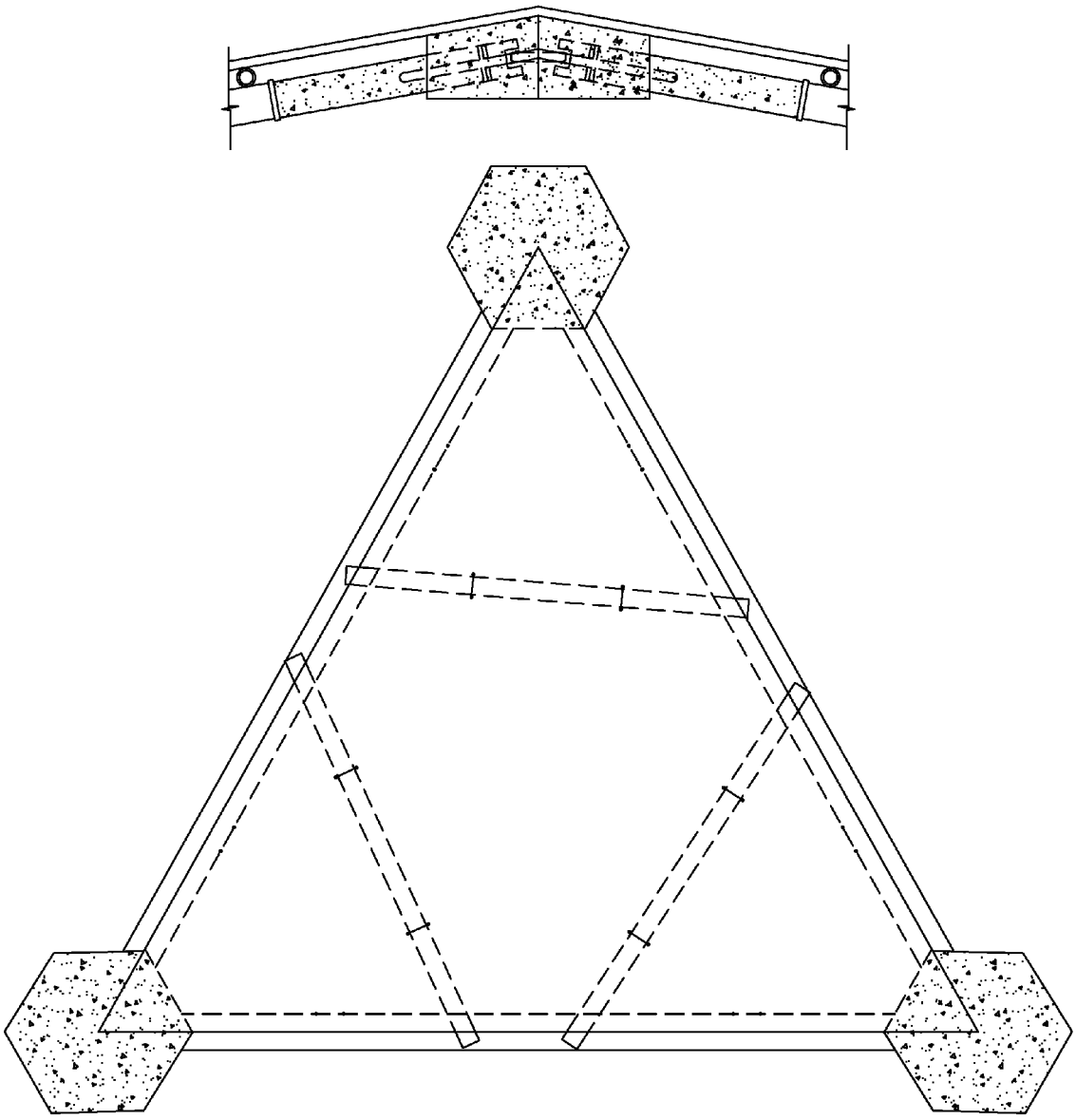
FIG. 23 illustrates a view of "CCB" panel attachment to struts.
Figure 24:
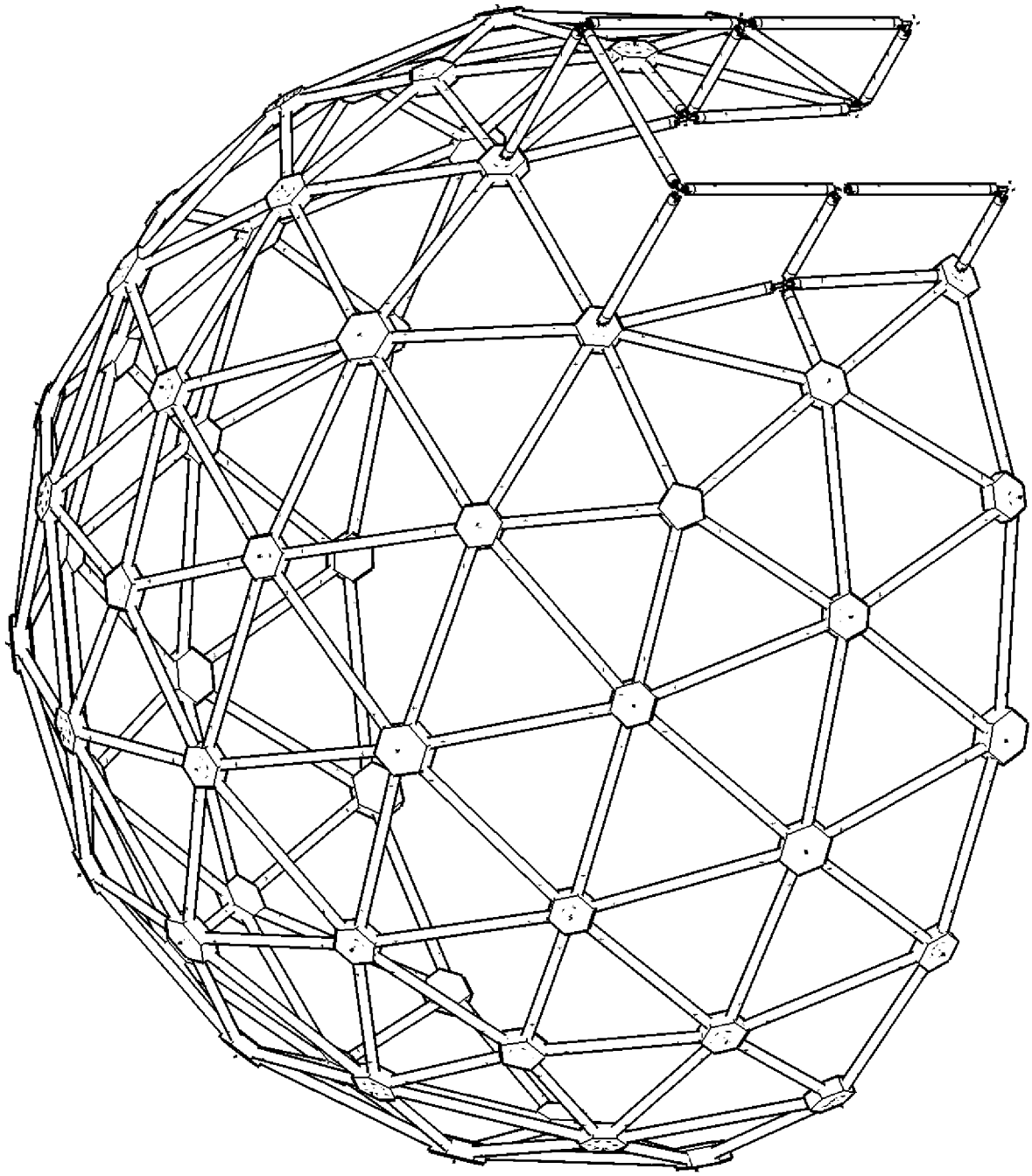
FIG. 24 illustrates a view of dome.
Figure 25:
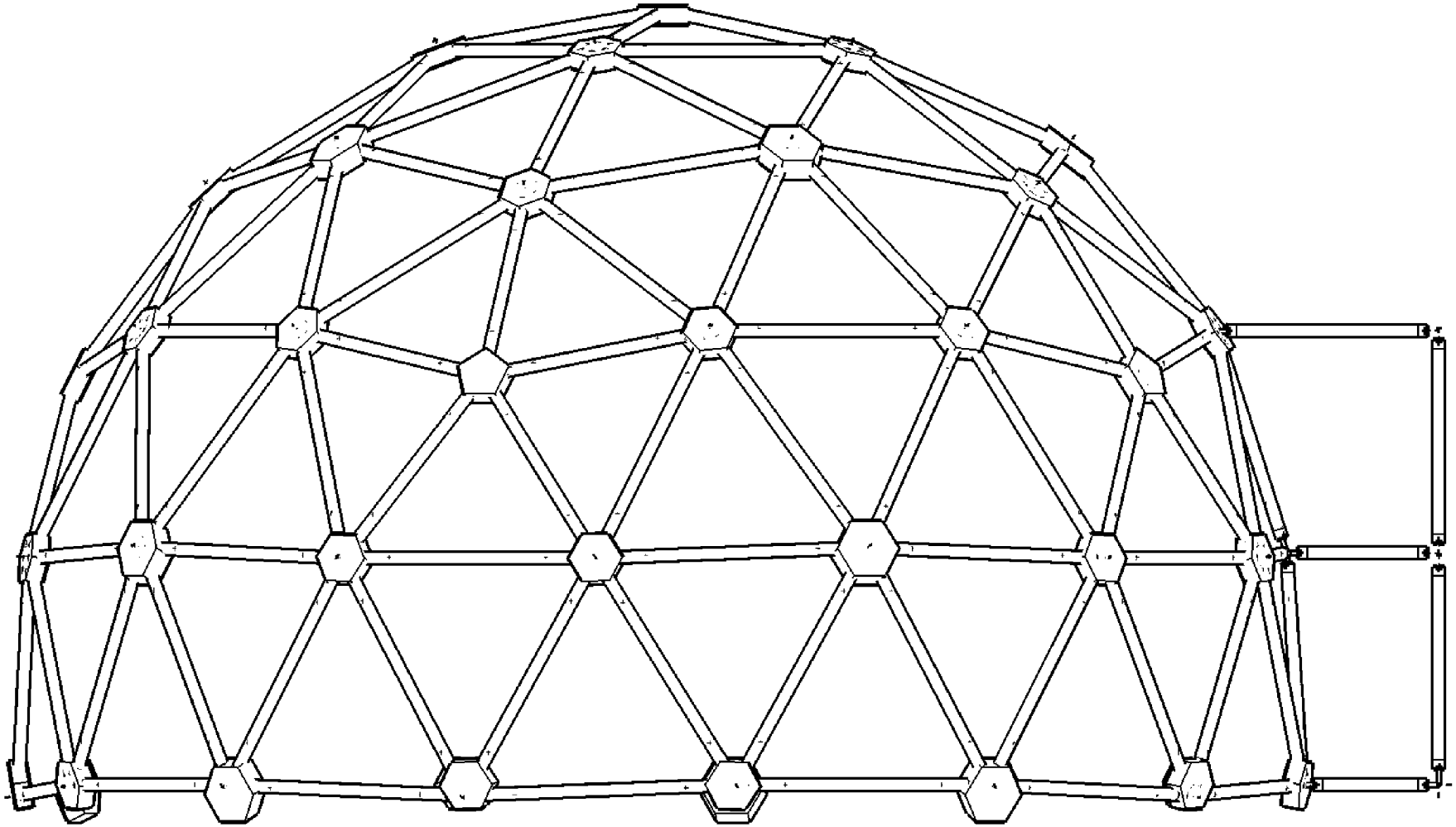
FIG. 25 illustrates a view of dome.
Figure 26:
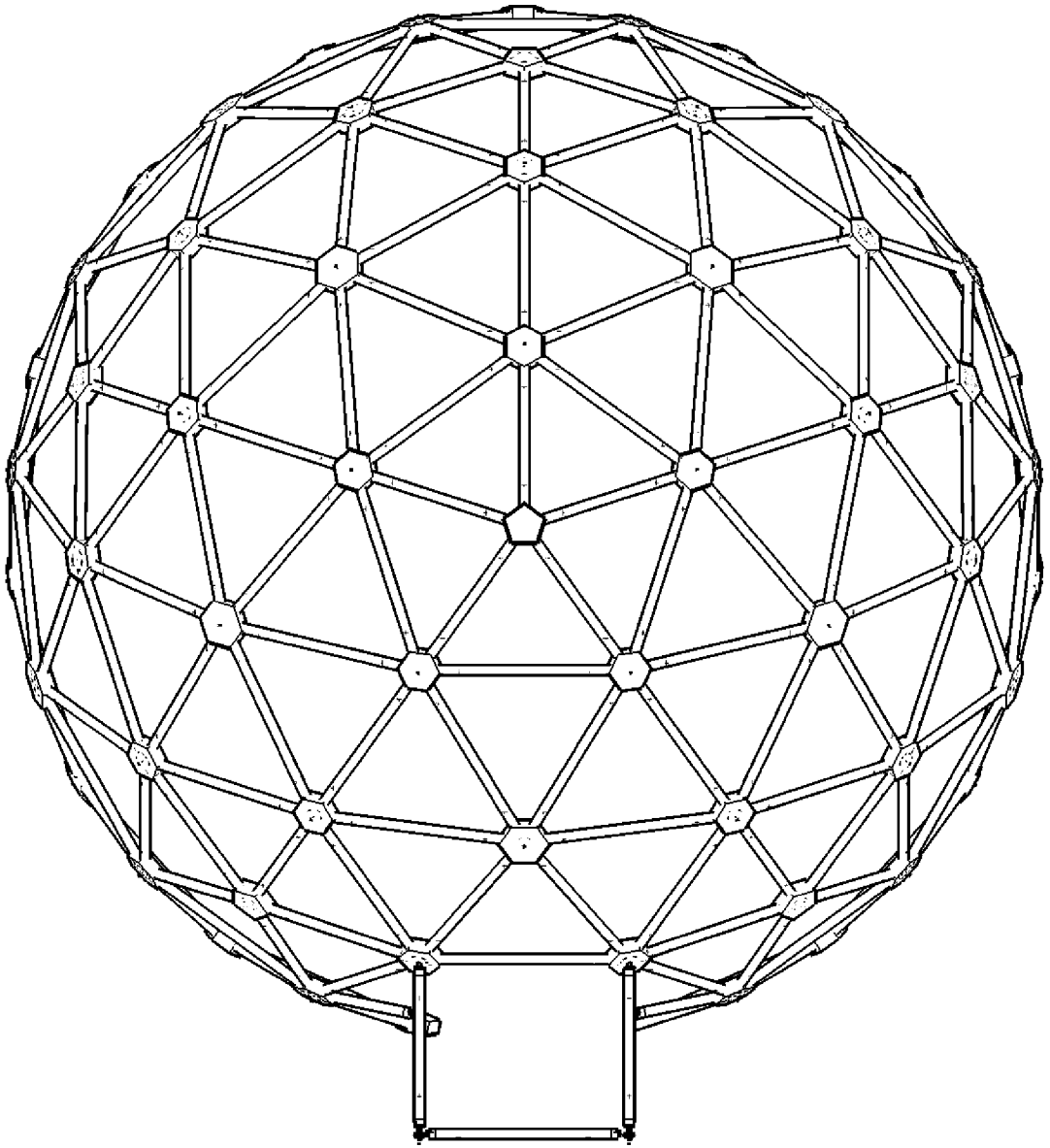
FIG. 26 illustrates a view of dome.

The preferred embodiment of the apparatus and the method for making same utilizes 37 hexagon hubs (FIG. 2), 6 pentagon hubs (FIG. 1), 13 half-hexagon hubs (FIGS. 3), and 6 entry hubs. The 6 entry hubs include 2 entry midway Ts (FIG. 4), 2 entry tops (FIG. 5 & FIG. 6), and 2 entry bottoms (FIG. 7 & FIG. 8). The hubs are produced with cylindrical and notched jigs (FIG. 19 & FIG. 20).

The jigs (FIG. 19 & FIG. 20) used to fashion the hubs are cylinders 2 inches high by 3.125 inches in diameter with 5 (for pentagon hubs) or 6 (for hexagon hubs) 0.5 inch by 0.5 inch notches (1901 & 2001) fashioned at equidistant intervals around the cylinder edge. (Notches are cut at 72 degree intervals for pentagon hubs and 60 degree intervals for hexagon hubs.) Placing the jigs on a flat surface with notched ends up will provide the proper inclination to achieve a 10 degree pronation of 8 inch long #4 rebar inserts with ends touching at the center to form a hub. Placing the 8 inch long #4 rebar inserts in the notched locations around the top of the jig with ends touching will set the inserts at the proper angles for strut orientation.

The 37 hexagon hubs (FIG. 2) are created by placing 6-8 inch long #4 rebar inserts (201) into a jig for hexagon hubs, described above, and welding the ends of the rebar inserts together in the center of the jig. 6-2 inch locking bars (202) are welded between the rebar inserts near the center of the hub.

The 6 pentagon hubs (FIG. 1) are created by placing 5-8 inch long #4 rebar inserts (101) into a jig for pentagon hubs, described above, and welding the ends of the rebar inserts together in the center of the jig. 5-3 inch locking bars (102) are welded between the rebar inserts near the center of the hub.

The 13 half-hexagons (FIG. 3) are created by placing 4-8 inch long #4 rebar inserts (301) into 4 adjacent notches in a jig for hexagon hubs, described above, and welding the ends of the rebar inserts together in the center of the jig. 3-2 inch locking bars (302) are welded between the rebar inserts near the center of the hub.

The 2 entry midway Ts (FIG. 4) are created by welding an 8 inch long #4 rebar insert (402) at the center point of a 16 inch long section of #4 rebar (401) at a 90 degree angle.

The 2 mirrored entry tops (FIG. 5 & FIG. 6) are created by placing 5-8 inch long #4 rebar inserts (501 & 601) into a jig for hexagon hubs, described above, and welding the ends of the rebar inserts together in the center of the jig. 4-2 inch locking bars (502 & 602) are welded between the rebar inserts near the center of the hub. A $6^{th}$ 8 inch long #4 rebar insert (503 & 603) is welded into the hub creating a 90 degree angle in relation to the left adjacent insert and 30 degree angle in relation to the right adjacent insert. For the mirrored entry top, a $6^{th}$ 8 inch long #4 rebar insert is welded into the hub creating a 90 degree angle in relation to the right adjacent insert and 30 degree angle in relation to the left adjacent insert.

The 2 mirrored entry bottoms (FIG. 7 & FIG. 8) are created by placing 2-8 inch long #4 rebar inserts (701 & 801) into 2 adjacent notches in a jig for hexagon hubs, described above, and welding the ends of the rebar inserts together in the center of the jig. 1-2 inch locking bar (702 & 802) is welded between the rebar inserts near the center of the hub. A $3^{rd}$ 8 inch long #4 rebar insert (703 & 803) is welded into the hub creating a 270 degree angle in relation to the left adjacent insert and 30 degree angle in relation to the right adjacent insert. For the mirrored entry bottom, a $3^{rd}$ 8 inch long #4 rebar insert is welded into the hub creating a 30 degree angle in relation to the right adjacent insert and 270 degree angle in relation to the left adjacent insert.

Struts.

Figure 9:
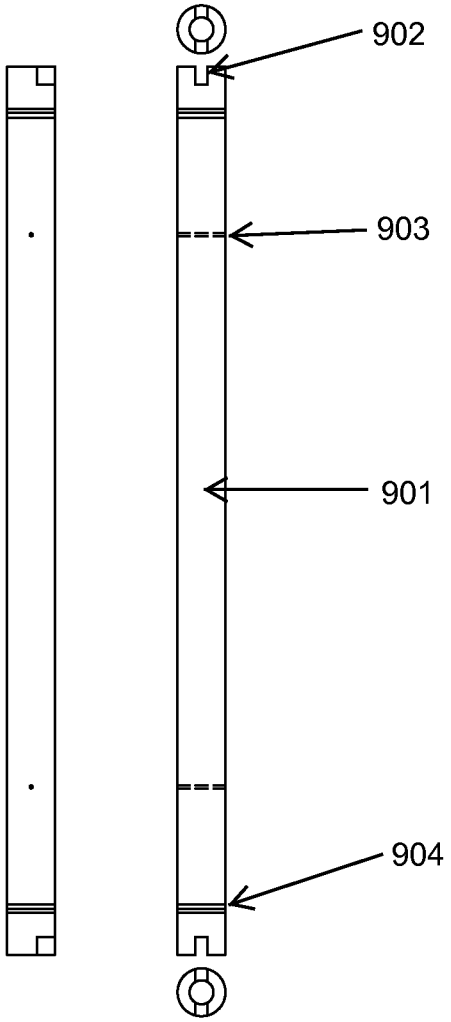
FIG. 9 illustrates a view of "A" strut.
Figure 11:
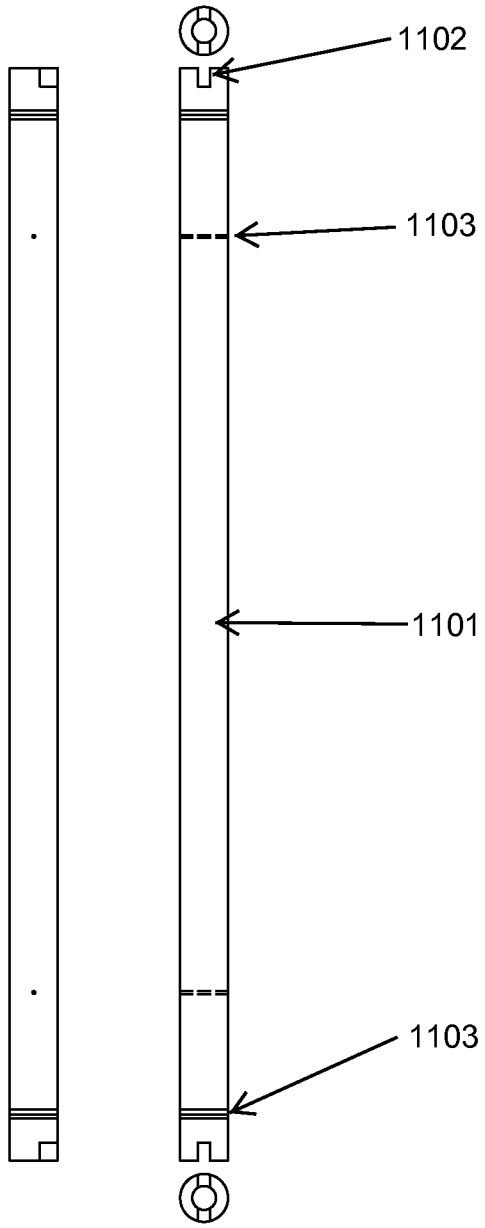
FIG. 11 illustrates a view of "C" strut.
Figure 12:
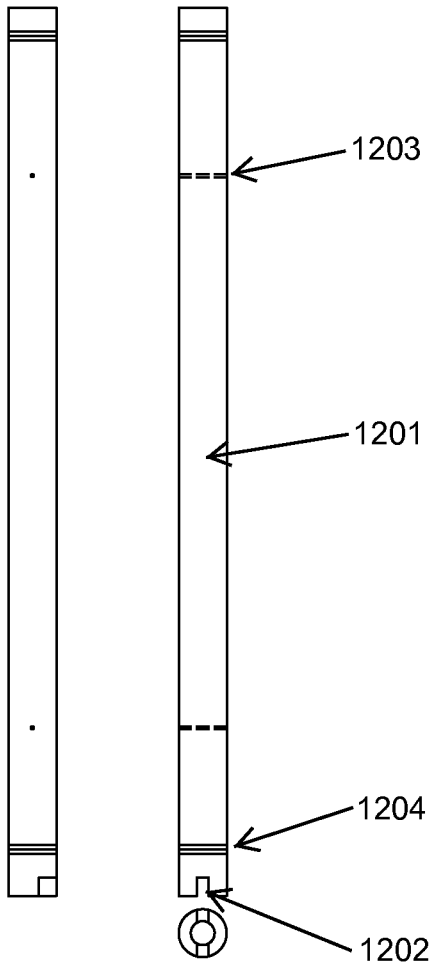
FIG. 12 illustrates a view of entryway strut.
Figure 13:
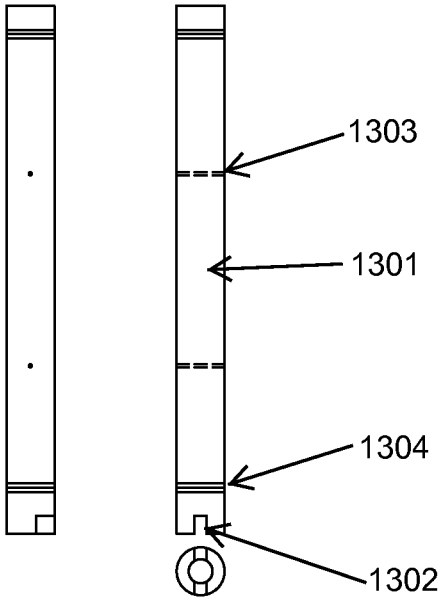
FIG. 13 illustrates a view of entry midway strut.

The preferred embodiment of the apparatus and the method for making same utilizes 30 "A Struts" (FIG. 9), 54 "B Struts" (FIG. 10), 74 "C Struts" (FIG. 11), 4 "Entry Struts" (FIGS. 12), and 2 "Entry Midway Struts" (FIG. 13). The struts may be created with wood, rebar, bamboo, pvc pipe, or any other appropriate available material. The preferred embodiment described herein utilizes bamboo.

The 30 "A Struts" (FIG. 9) are each created with a 37 inch length of bamboo (901) approximately 2 inches in diameter. The bamboo is notched across each end (902) 0.5 inches wide by 0.75 inches deep and in alignment. A 0.125 inch hole (903) is drilled through the strut 7 inches from each end for 2-28 inch lengths of wire (14.5 gauge steel wire or an equivalent) that will tie off to the hubs. 2-24 inch lengths of wire (904) (14.5 gauge steel wire or an equivalent) are wrapped three times around each strut at points approximately 1 inch from each notch.

The 54 "B Struts" (FIG. 10) are each created with a 42 inch length of bamboo (1001) approximately 2 inches in diameter. The bamboo is notched across each end (1002) 0.5 inches wide by 0.75 inches deep and in alignment. A 0.125 inch hole (1003) is drilled through the strut 7 inches from each end for 2-28 inch lengths of wire (14.5 gauge steel wire or an equivalent) that will tie off to the hubs. 2-24 inch lengths of wire (1004) (14.5 gauge steel wire or an equivalent) are wrapped three times around each strut at points approximately 1 inch from each notch.

The 74 "C Struts" (FIG. 11) are each created with a 43.5 inch length of bamboo (1101) approximately 2 inches in diameter. The bamboo is notched across each end (1102) 0.5 inches wide by 0.75 inches deep and in alignment. A 0.125 inch hole (1103) is drilled through the strut 7 inches from each end for 2-28 inch lengths of wire (14.5 gauge steel wire or an equivalent) that will tie off to the hubs. 2-24 inch lengths of wire (1104) (14.5 gauge steel wire or an equivalent) are wrapped three times around each strut at points approximately 1 inch from each notch.

The 4 "Entry Struts" (FIG. 12) are each created with a 37 inch length of bamboo (1201) approximately 2 inches in diameter. The bamboo is notched across one end (1202) 0.5 inches wide by 0.75 inches deep and in alignment. A 0.125 inch hole (1203) is drilled through the strut 7 inches from each end for 2-28 inch lengths of wire (14.5 gauge steel wire or an equivalent) that will tie off to the hubs. 2-24 inch lengths of wire (1204) (14.5 gauge steel wire or an equivalent) are wrapped three times around each strut at points approximately 2 inches from each end.

The 2 "Entry Midway Struts" (FIG. 13) are each created with a 22 inch length of bamboo (1301) approximately 2 inches in diameter. The bamboo is notched across one end (1302) 0.5 inches wide by 0.75 inches deep and in alignment. A 0.125 inch hole (1303) is drilled through the strut 7 inches from each end for 2-28 inch lengths of wire (14.5 gauge steel wire or an equivalent) that will tie off to the hubs. 2-24 inch lengths of wire (1304) (14.5 gauge steel wire or an equivalent) are wrapped three times around each strut at points approximately 2 inches from each end.

Forms.

Figure 15:
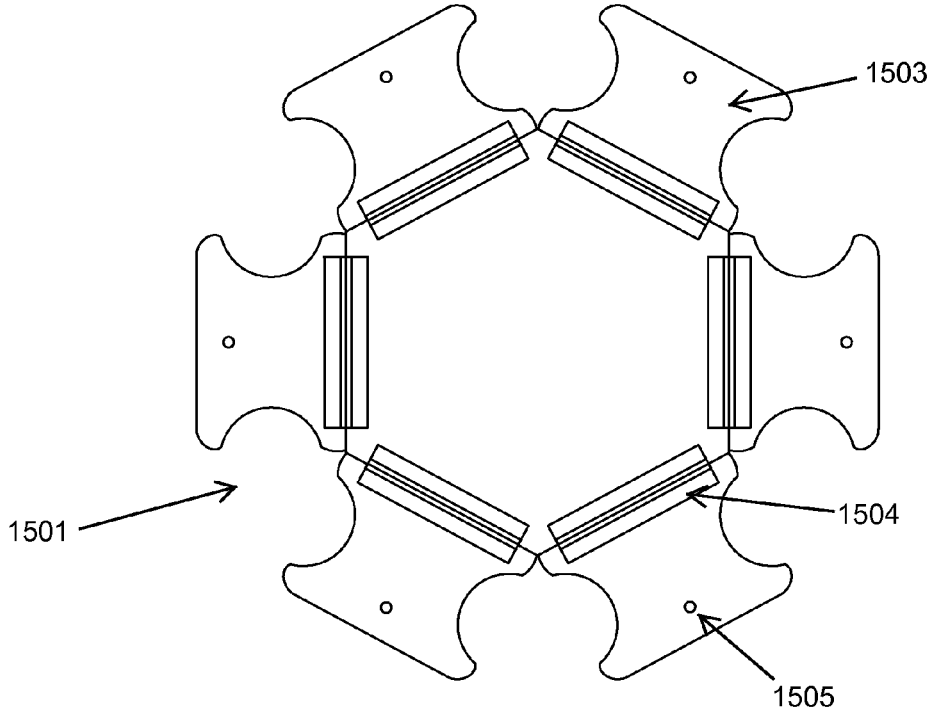
FIG. 15 illustrates a view of hexagon form.
Figure 15:
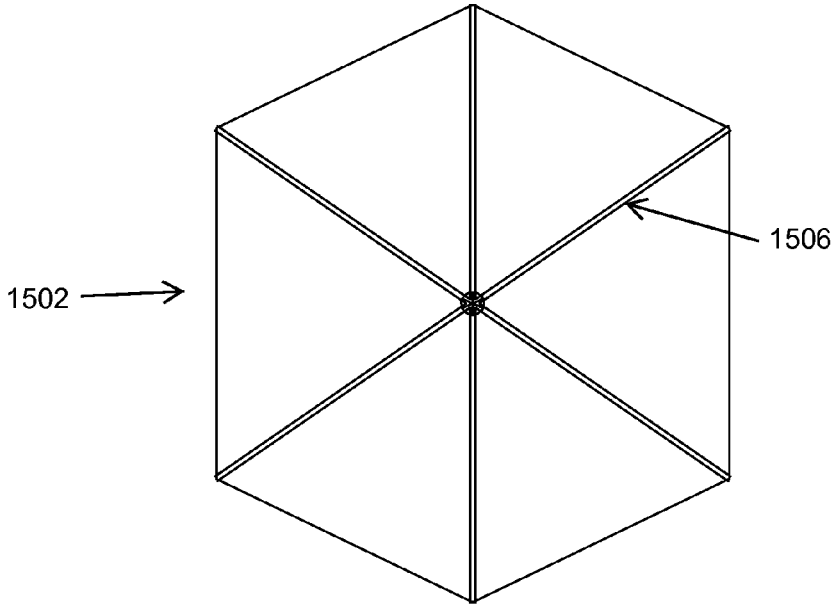
Figure 16:
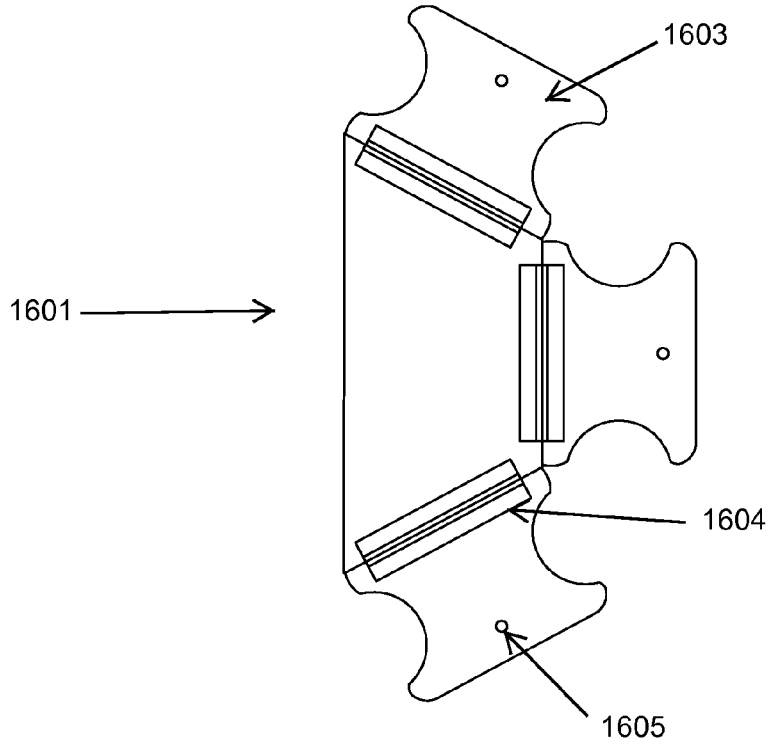
FIG. 16 illustrates a view of ½ hexagon form.
Figure 16:
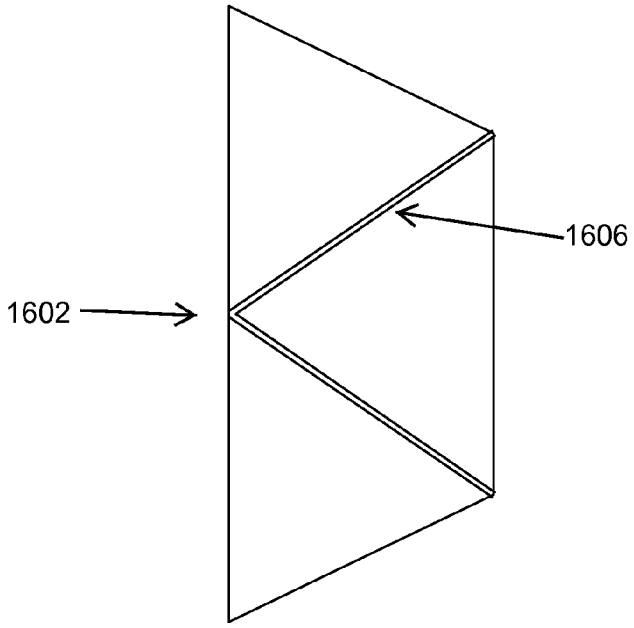
Figure 17:
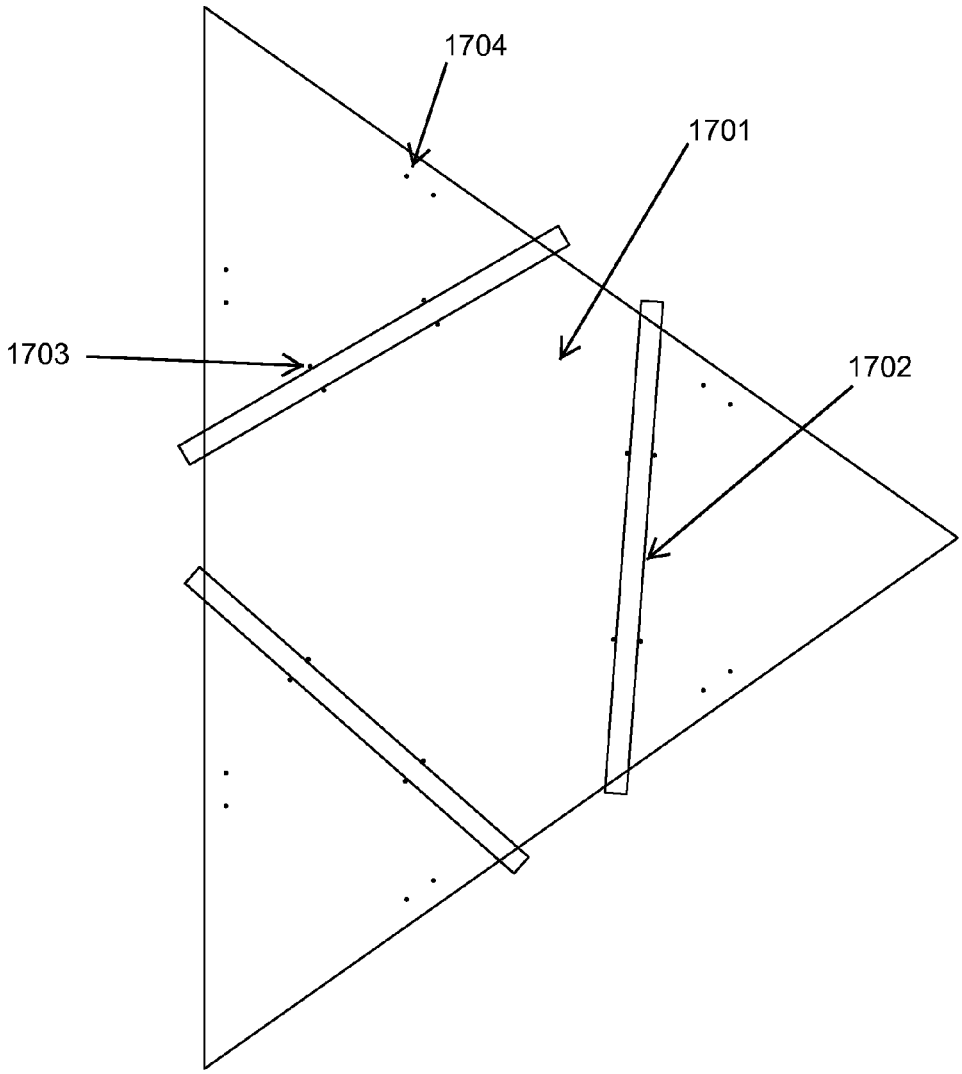
FIG. 17 illustrates a view of "AAB" panel.
Figure 18:
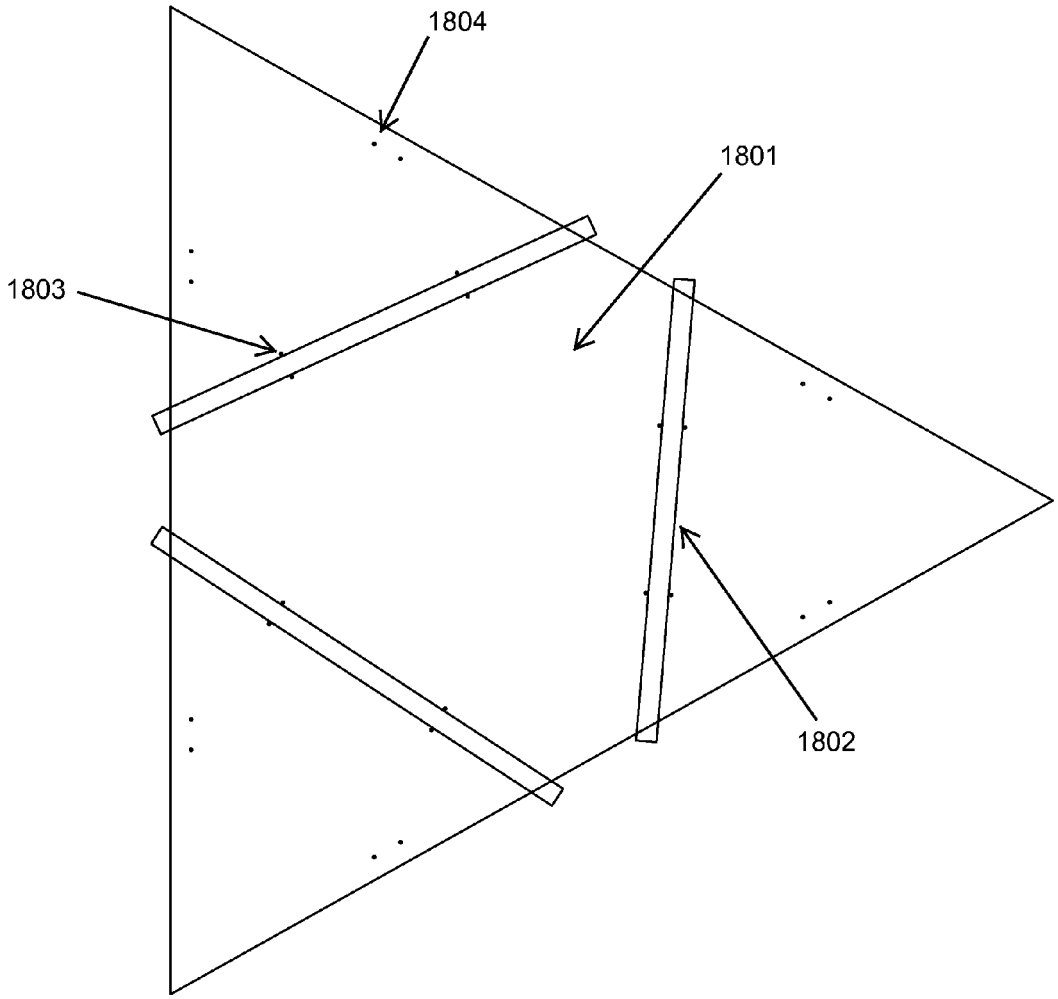
FIG. 18 illustrates a view of "CCB" panel.

The preferred embodiment of the apparatus and the method for making same utilizes 6 "Pentagon Forms" (FIG. 14), 37 "Hexagon Forms" (FIG. 15), and 13 "Half-Hexagon Forms" (FIG. 16). The forms may be created with wood, cardboard, oriented strand board, particleboard, or any other appropriate available material. The preferred embodiment described herein utilizes oriented strand board ("OSB").

Figure 14:
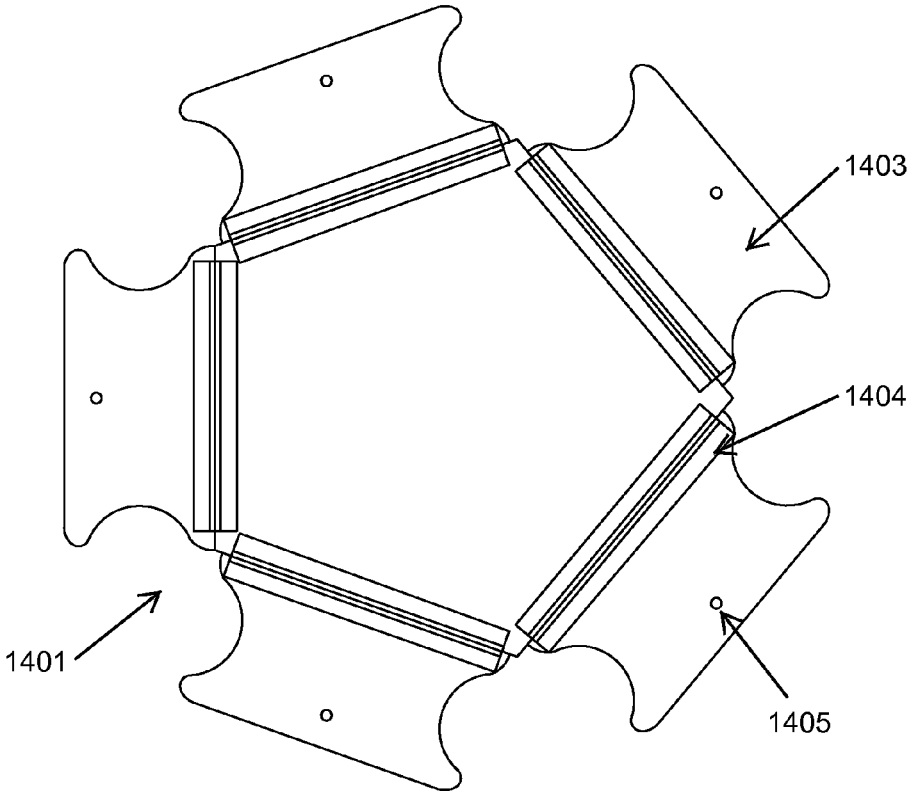
FIG. 14 illustrates a view of pentagon form.
Figure 14:
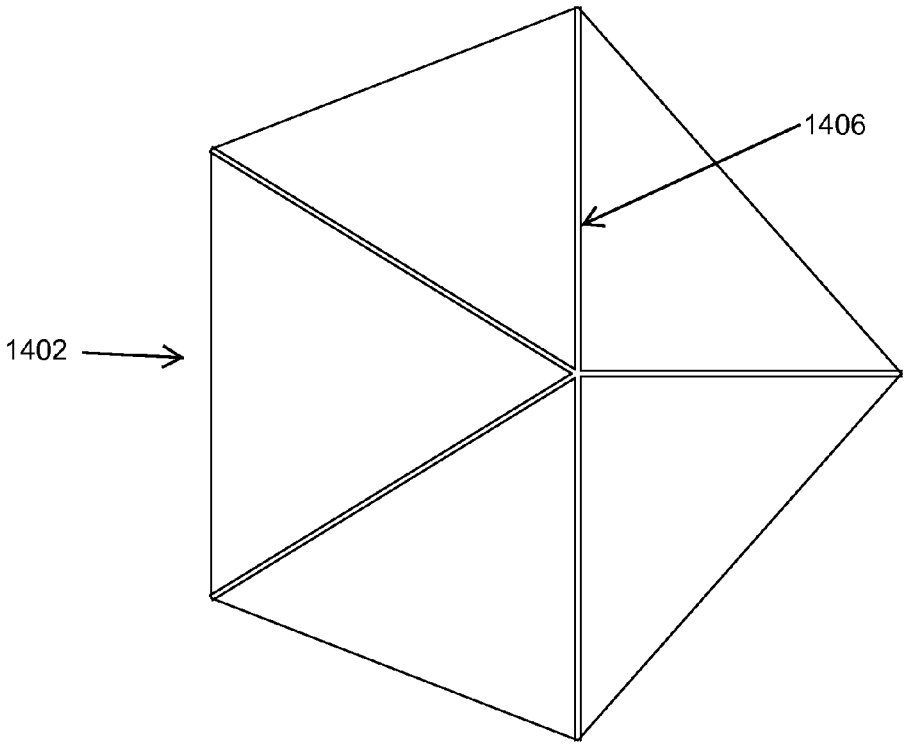

The Pentagon Forms (FIG. 14) each necessitate one 12 inch by 12 inch OSB square to form an inner pentagon (1401), one 16 inch by 17 inch OSB rectangle to form an outer pentagon (1402), five 3.5 inch by 7 inch hourglass shaped flaps (1403), one piece of 50 inch length string, fifteen pieces of 5 inch length tape (1404), five 1 inch screws, and three pieces of 29 inch wire (14.5 gauge steel wire or an equivalent). The OSB squares are cut into pentagons as shown in FIG. 14; the five 3.5 inch by 7 inch hourglass shaped flaps are cut as shown in FIG. 14. One 1 inch screw is screwed into the center of each flap (1405) approximately 0.75 inches from the outside edge as shown in FIG. 14. The inside edges of the flaps (edge opposite screw) are connected to the corresponding edges of the inner pentagon via the tape pieces described above—one piece of tape for the top side of the combination and one piece of tape for the bottom side of the combination as shown in FIG. 14. One end of the string described above is tied to one screw head. The OSB may be sealed to prevent water penetration. The outer pentagon (1402) may contain groves (1406).

The Hexagon Forms (FIG. 15) each necessitate one 10 inch by 9 inch OSB rectangle to form an inner hexagon (1501), one 12 inch by 14 inch OSB rectangle to form an outer hexagon (1502), six 3.5 inch by 5.25 inch hourglass shaped flaps (1503), one piece of 48 inch length string, eighteen pieces of 5.25 inch length tape (1504), six 1 inch screws, and three pieces of 26 inch wire (14.5 gauge steel wire or an equivalent). The OSB squares are cut into hexagons as shown in FIG. 15; the six 3.5 inch by 5.25 inch hourglass shaped flaps are cut as shown in FIG. 15. One 1 inch screw is screwed into the center of each flap (1505) approximately 0.75 inches from the outside edge as shown in FIG. 15. The inside edges of the flaps (edge opposite screw) are connected to the corresponding edges of the inner hexagon via the tape pieces described above—one piece of tape for the top side of the combination and one piece of tape for the bottom side of the combination as shown in FIG. 15. One end of the string described above is tied to one screw head. The OSB may be sealed to prevent water penetration. The outer hexagon (1502) may contain groves (1506).

The Half-Hexagon Forms (FIG. 16) each necessitate one 10 inch by 4.5 inch OSB rectangle to form an inner half-hexagon (1601), one 6 inch by 14 inch OSB rectangle to form an outer half-hexagon (1602), three 3.5 inch by 5.25 inch hourglass shaped flaps (1603), one piece of 24 inch length string, nine pieces of 5.25 inch length tape (1604), three 1 inch screws, and three pieces of 26 inch wire (14.5 gauge steel wire or an equivalent). The OSB squares are cut into half-hexagons as shown in FIG. 16; the three 3.5 inch by 5.25 inch hourglass shaped flaps are cut as shown in FIG. 16. One 1 inch screw is screwed into the center of each flap approximately 0.75 inches from the outside edge as shown in FIG. 16. The inside edges of the flaps (edge opposite screw) are connected to the corresponding edges of the inner hexagon via the tape pieces described above—one piece of tape for the top side of the combination and one piece of tape for the bottom side of the combination as shown in FIG. 16. One end of the string described above is tied to one screw head. The OSB may be sealed to prevent water penetration. The outer half-hexagon (1602) may contain groves (1606).

Frame Assembly.

1$^{st}$ Step: Collect 5 A Struts.

2$^{nd}$ Step: Fill the end of one A Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four A Struts.

3$^{rd}$ Step: Collect 1 Pentagon Hub.

4$^{th}$ Step: Use a mallet to drive the prepared A Struts onto the Pentagon Hub; locking the strut notches into the hub pins. Use the wires on the struts to secure the struts to the hub, by guiding the wires through the spaces on opposing sides of the hub and twisting the wires tight enough to prevent the strut from separating from the hub.

5$^{th}$ Step: Collect 5 Hexagon Hubs.

6$^{th}$ Step: Use a mallet to drive the Hexagon Hubs into the A Struts protruding from the prepared pentagon hubs. Lock the strut notches into the hub pins. Use the wires on the struts to secure the struts to the hub. Guide the wires through the spaces on opposing sides of the hub and twist the wires tight enough to prevent the strut from separating from the hub.

7$^{th}$ Step: Collect 5 B Struts.

8$^{th}$ Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four B Struts.

9$^{th}$ Step: Use a mallet to drive the B Struts, onto the adjacent inserts and pins of the Hexagon Hubs, next to the A Struts; locking the strut notches into the hub pins. Use the wires on the struts to secure the struts to the hub, by guiding the wires through the spaces on opposing sides of the hub and twisting the wires tight enough to prevent the strut from separating from the hub. A Pentagon is now formed out of the A and B Struts.

10$^{th}$ Step: Collect 10 C Struts.

11$^{th}$ Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine C Struts.

12$^{th}$ Step: Use a mallet to drive the C Struts onto the adjacent inserts and pins of the Hexagon Hubs, next to the B Struts, onto the ends of the Pentagon's apexes; locking the strut notches into the hub pins. Use the wires on the struts to secure the struts to the hub, by guiding the wires through the spaces on opposing sides of the hub and twisting the wires tight enough to prevent the strut from separating from the hub.

13$^{th}$ Step: Collect 5 B Struts.

14$^{th}$ Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four B Struts.

15$^{th}$ Step: Use a mallet to drive the B Struts, onto the remaining inserts and pins; locking the strut notches into the hub pins, of the Hexagon Hubs. Use the wires on the struts to secure the struts to the hub, by guiding the wires through the spaces on opposing sides of the hub and twisting the wires tight enough to prevent the strut from separating from the hub.

16$^{th}$ Step: Collect 10 Hexagon Hubs.

17$^{th}$ Step: Use a mallet and drive one Hexagon Hub, into the B Strut; locking the strut notches into the hub pin. Use the wires on the struts to secure the strut to the hub, by guiding the wires through the spaces on opposing sides of the hub and twisting the wires tight enough to prevent the strut from separating from the hub.

18$^{th}$ Step: Collect 10 C Struts.

19$^{th}$ Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine A Struts.

20$^{th}$ Step: Use a mallet and drive one C Strut into the insert and pins of the Hexagon Hub that is adjacent to the B Strut; locking the strut notches into the hub pins. Use the wires on the struts to secure the struts to the hub, by guiding the wires through the spaces on opposing sides of the hub and twisting the wires tight enough to prevent the strut from separating from the hub.

21$^{st}$ Step: Use a mallet and drive one Hexagon Hub into the adjacent C, C, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

22$^{nd}$ Step: Use a mallet and drive one C Strut into the horizontal insert and pins of the Hexagon Hub that is adjacent to the C Struts; locking the strut notches into the hub pins. Use the wires on the struts to secure the struts to the hub, by guiding the wires through the spaces on opposing sides of the hub and twisting the wires tight enough to prevent the strut from separating from the hub.

23$^{rd}$ Step: Use a mallet and drive one Hexagon Hub into the B Strut and C Strut; locking the strut notches into the hub pins. Use the wires on the struts to secure the struts to the hub, by guiding the wires through the spaces on opposing sides of the hub and twisting the wires tight enough to prevent the strut from separating from the hub.

24$^{th}$ Step: Use a mallet and drive one C Strut into the insert and pins of the Hexagon Hub that is adjacent to the B Strut; locking the strut notches into the hub pins. Use the wires on the struts to secure the struts to the hub, by guiding the wires through the spaces on opposing sides of the hub and twisting the wires tight enough to prevent the strut from separating from the hub.

25th Step: Use a mallet and drive one Hexagon Hub into the adjacent C, C, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

26th Step: Use a mallet and drive one C Strut into the horizontal insert and pins of the Hexagon Hub that is adjacent to the C Struts; locking the strut notches into the hub pins. Use the wires on the struts to secure the struts to the hub, by guiding the wires through the spaces on opposing sides of the hub and twisting the wires tight enough to prevent the strut from separating from the hub.

27th Step: Repeat Steps 23 through 26 three times. This will bring you to the Hexagon Hub, where you will attach the end of the C Strut into the insert and pins of the Hexagon Hub, that is adjacent to the B Strut; locking the strut notches into the hub pins. Use the wires on the struts to secure the struts to the hub, by guiding the wires through the spaces on opposing sides of the hub and twisting the wires tight enough to prevent the strut from separating from the hub.

28th Step: Collect 5 A Struts.

29th Step: Fill the end of one A Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four A Struts.

30th Step: Use a mallet and drive the A Struts, onto the ends of the Hexagon Hubs, which are opposite to or across from, the B Struts; locking the strut notches into the hub pins. Use the wires on the struts to secure the struts to the hub, by guiding the wires through the spaces on opposing sides of the hub and twisting the wires tight enough to prevent the strut from separating from the hub.

31st Step: Collect 10 B Struts.

32nd Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine B Struts.

33rd Step: Use a mallet and drive the B Struts onto the remaining inserts and pins, of the Hexagon Hub, adjacent to the A Struts; locking the strut notches into the hub pins. Use the wires on the struts to secure the struts to the hub, by guiding the wires through the spaces on opposing sides of the hub and twisting the wires tight enough to prevent the strut from separating from the hub.

34th Step: Collect 10 C Struts.

35th Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine C Struts.

36th Step: Use a mallet and drive the C Struts, onto the remaining inserts and pins of the Hexagon Hubs; locking the strut notches into the hub pins. Use the wires on the struts to secure the struts to the hub, by guiding the wires through the spaces on opposing sides of the hub and twisting the wires tight enough to prevent the strut from separating from the hub.

37th Step: Collect 5 B Struts.

38th Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four B Struts.

39th Step: Collect 10 A Struts

40th Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine C Struts.

41st Step: Collect 1 Right Entry Top Hub and locate the orientation of the door.

42nd Step: Insert the right hand side Entry Top Hub, into the ends of one B Strut and one C Strut. Use a mallet and drive the upper door opening hub into the B Strut and C Strut; locking the strut notches into the hub pins. Use the wires on the struts to secure the struts to the hub, by guiding the wires through the spaces on opposing sides of the hub and twisting the wires tight enough to prevent the strut from separating from the hub.

43rd Step: Use a mallet and drive one B Strut, onto the insert of the Entry Top Hub, that is adjacent to the C Strut. Use the wires on the struts to secure the struts to the hub, by guiding the wires through the spaces on opposing sides of the hub and twisting the wires tight enough to prevent the strut from separating from the hub.

44th Step: Collect 1 Left Entry Top Hub.

45th Step: Insert the left hand side Entry Top Hub into the ends of the two B Struts and one C Strut, that are opposite of the right hand side Entry Top Hub. Use a mallet and drive the upper door opening hub into the B Struts and C Strut; locking the strut notches into the hub pins. Use the wires on the struts to secure the struts to the hub, by guiding the wires through the spaces on opposing sides of the hub and twisting the wires tight enough to prevent the strut from separating from the hub.

46th Step: Use a mallet and drive one A Strut, into the left hand side insert and pins of the Entry Top Hub, that is adjacent to the B Strut; locking the strut notches into the hub pins. Use the wires on the struts to secure the struts to the hub, by guiding the wires through the spaces on opposing sides of the hub and twisting the wires tight enough to prevent the strut from separating from the hub.

47th Step: Collect 5 Pentagon Hubs.

48th Step: Use a mallet and drive one Pentagon Hub into the ends of the two A Struts; locking the strut notches into the hub pins. Use the wires on the struts to secure the struts to the hub, by guiding the wires through the spaces on opposing sides of the hub and twisting the wires tight enough to prevent the strut from separating from the hub.

49th Step: Use a mallet and drive one A Strut, onto the upper left hand side insert and pins of the Pentagon Hub; locking the strut notches into the hub pins. Use the wires on the struts to secure the struts to the hub, by guiding the wires through the spaces on opposing sides of the hub and twisting the wires tight enough to prevent the strut from separating from the hub.

50th Step: Collect 8 Hexagon Hubs.

51st Step: Use a mallet and drive the inserts and pins of the Hexagon Hub into the A, B, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

52nd Step: Use a mallet and drive one B Strut, onto the insert and pins of the Hexagon Hub, that is adjacent to the C Strut; locking the strut notches into the hub pins. Use the wires on the struts to secure the struts to the hub, by guiding the wires through the spaces on opposing sides of the hub and twisting the wires tight enough to prevent the strut from separating from the hub.

53rd Step: Use a mallet and drive the inserts and pins of one Hexagon Hub into the B, B, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

54th Step: Use a mallet and drive one A Strut, onto the upper left hand side insert and pins of the Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

55th Step: Use a mallet and drive one Pentagon Hub into the ends of the two A Struts; locking the strut notches into the hub pins. Use the wires on the struts to secure the struts to the hub, by guiding the wires through the spaces on opposing sides of the hub and twisting the wires tight enough to prevent the strut from separating from the hub.

56th Step: Use a mallet and drive one A Strut, onto the upper left hand side insert and pins of the Pentagon Hub; locking the strut notches into the hub pins. Use the wires on the struts to secure the struts to the hub, by guiding the wires through the spaces on opposing sides of the hub and twisting the wires tight enough to prevent the strut from separating from the hub.

57th Step: Repeat Steps 52 through 57 three times. This will bring you to the Right Entry Top Hub.

58th Step: Insert the A Strut onto the insert and pins of the Right Entry Top Hub, which is adjacent to the B Strut.

59th Step: Collect 10 A Struts.

60th Step: Fill the end of one A Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine A Struts.

61st Step: Use a mallet and drive the A Struts onto the insert and pins of the Pentagon Hubs; locking the strut notches into the hub pins. Use the wires on the struts to secure the struts to the hub, by guiding the wires through the spaces on opposing sides of the hub and twisting the wires tight enough to prevent the strut from separating from the hub.

62nd Step: Collect 10 B Struts.

63rd Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine B Struts.

64th Step: Use a mallet and drive the B Struts onto the insert and pins of the Hexagon Hubs, that are adjacent to the Pentagon Hubs; locking the strut notches into the hub pins. Use the wires on the struts to secure the struts to the hub, by guiding the wires through the spaces on opposing sides of the hub and twisting the wires tight enough to prevent the strut from separating from the hub.

65th Step: Collect 8 C Struts.

66th Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining seven C Struts.

67th Step: Use a mallet and drive the C Struts, onto the remaining inserts and pins of the Hexagon Hubs; locking the strut notches into the hub pins. Use the wires on the struts to secure the struts to the hub, by guiding the wires through the spaces on opposing sides of the hub and twisting the wires tight enough to prevent the strut from separating from the hub.

68th Step: Collect 5 B Struts.

69th Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining four B Struts.

70th Step: Collect 8 C Struts.

71st Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining seven C Struts.

72nd Step: Collect 14 Hexagon Hubs.

73rd Step: Start at the left of the door opening, use a mallet and drive one Hexagon Hub into the A and B Struts; locking the strut notches into the hub pins. Use the wires on the struts to secure the struts to the hub, by guiding the wires through the spaces on opposing sides of the hub and twisting the wires tight enough to prevent the strut from separating from the hub.

74th Step: Use a mallet and drive one B Strut into the horizontal insert and pins of the Hexagon Hub, that is adjacent to the A Strut; locking the strut notches into the hub pins. Use the wires on the struts to secure the struts to the hub, by guiding the wires through the spaces on opposing sides of the hub and twisting the wires tight enough to prevent the strut from separating from the hub.

75th Step: Use a mallet and drive one Hexagon Hub into the ends of the B, A, and B Struts; locking the strut notches into the hub pins. Use the wires on the struts to secure the struts to the hub, by guiding the wires through the spaces on opposing sides of the hub and twisting the wires tight enough to prevent the strut from separating from the hub.

76th Step: Use a mallet and drive one C Strut into the horizontal insert and pins of the Hexagon Hub, that is adjacent to the B Strut; locking the strut notches into the hub pins. Use the wires on the struts to secure the struts to the hub, by guiding the wires through the spaces on opposing sides of the hub and twisting the wires tight enough to prevent the strut from separating from the hub.

77th Step: Use a mallet and drive one Hexagon Hub into the ends of the C, C, and C, Struts; locking the strut notches into the hub pins. Use the wires on the struts to secure the struts to the hub, by guiding the wires through the spaces on opposing sides of the hub and twisting the wires tight enough to prevent the strut from separating from the hub.

78th Step: Use a mallet and drive one C Strut into the horizontal insert and pins of the Hexagon Hub, that is adjacent to the C Strut; locking the strut notches into the hub pins. Use the wires on the struts to secure the struts to the hub, by guiding the wires through the spaces on opposing sides of the hub and twisting the wires tight enough to prevent the strut from separating from the hub.

79th Step: Use a mallet and drive one Hexagon Hub into the ends of the A, B, & C Struts; locking the strut notches into the hub pins. Use the wires on the struts to secure the struts to the hub, by guiding the wires through the spaces on opposing sides of the hub and twisting the wires tight enough to prevent the strut from separating from the hub.

80th Step: Use a mallet and drive one B Strut into the horizontal insert and pins of the Hexagon Hub, that is adjacent to the A Strut; locking the strut notches into the hub pins. Use the wires on the struts to secure the struts to the hub, by guiding the wires through the spaces on opposing sides of the hub and twisting the wires tight enough to prevent the strut from separating from the hub.

81st Step: Repeat Steps 76 through 81 three times. This will bring you to the right hand side of the doorway.

82nd Step: Collect 10 B Struts.

83rd Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine B Struts.

84th Step: Use a mallet and drive the B Struts, onto the inserts and pins of the Hexagon Hubs, that are on the opposite side of the A Struts; locking the strut notches into the hub pins. Use the wires on the struts to secure the struts to the hub, by guiding the wires through the spaces on opposing sides of the hub and twisting the wires tight enough to prevent the strut from separating from the hub.

85th Step: Collect 18 C Struts.

86th Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining seventeen C Struts.

87th Step: Use a mallet and drive the C Struts, onto the remaining inserts and pins of the Hexagon Hubs; locking the strut notches into the hub pins. Use the wires on the struts to secure the struts to the hub, by guiding the wires through the spaces on opposing sides of the hub and twisting the wires tight enough to prevent the strut from separating from the hub.

88th Step: Collect 10 C Struts.

89th Step: Fill the end of one C Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining nine C Struts.

90th Step: Collect 4 B Struts.

91st Step: Fill the end of one B Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining three B Struts.

92nd Step: Collect 13 Half-Hexagon Hubs.

93rd Step: Use one Half-Hexagon Hub. Place it horizontally under the C Struts, to the left of the door opening. Use a mallet and drive the top two inserts and pins into the C Struts; locking the strut notches into the hub pins. Use the wires on the struts to secure the struts to the hub, by guiding the wires through the spaces on opposing sides of the hub and twisting the wires tight enough to prevent the strut from separating from the hub.

94th Step: Use a mallet and drive one C Strut it into the right insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

95th Step: Use a mallet and drive one C Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

96th Step: Use a mallet and drive one Half-Hexagon Hub into the C, B, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

97th Step: Use a mallet and drive one B Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

98th Step: Use a mallet and drive one Half-Hexagon Hub into the B, C, and B Struts; locking the strut notches into the hub pins. Use the wires on the struts to secure the struts to the hub, by guiding the wires through the spaces on opposing sides of the hub and twisting the wires tight enough to prevent the strut from separating from the hub.

99th Step: Use a mallet and drive one C Strut into the left horizontal insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

100th Step: Use one Half-Hexagon Hub. Place it horizontally under the C Struts. Use a mallet and drive it into the inserts and pins of the C, C, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

101st Step: Use a mallet and drive one C Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

102nd Step: Use a mallet and drive one Half-Hexagon Hub into the C, B, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

103rd Step: Use a mallet and drive one B Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

104th Step: Use a mallet and drive one Half-Hexagon Hub into the B, C, and B Struts; locking the strut notches into the hub pins. Use the wires on the struts to secure the struts to the hub, by guiding the wires through the spaces on opposing sides of the hub and twisting the wires tight enough to prevent the strut from separating from the hub.

105th Step: Use a mallet and drive one C Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

106th Step: Repeat Steps 98 through 103 three times. This will take you to the right hand side of the door.

107th Step: Use one Half-Hexagon Hub. Place it horizontally under the C Struts. Use a mallet and drive it into the inserts and pins of the C, C, and C Struts; locking the strut notches into the hub pins. Use the wires on the struts to secure the struts to the hub, by guiding the wires through the spaces on opposing sides of the hub and twisting the wires tight enough to prevent the strut from separating from the hub.

108th Step: Use a mallet and drive one C Strut into the left insert and pins of the Half-Hexagon Hub; locking the strut notches into the hub pins. Use the wires on the struts to secure the struts to the hub, by guiding the wires through the spaces on opposing sides of the hub and twisting the wires tight enough to prevent the strut from separating from the hub.

109th Step: Collect 4 Entry Struts.

110th Step: Fill the end of one Entry Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining three Entry Struts.

111th Step: Collect 2 Entry Midway Struts.

112th Step: Fill the end of one Entry Midway Strut with the fine mix of cement up to the strut's notch. Cover and secure the end to keep the cement from running out. Flip the strut over and fill the other end of the strut with the mix of fine cement up to the strut's notch and secure and cover. Repeat this step with the remaining Entry Midway Strut.

113th Step: Collect 2 Entry Bottom Hubs.

114th Step: Collect 2 Entry Midway "T" Hubs.

115th Step: Using a mallet, drive two Entry Struts onto the inserts of the Entry Top Hubs; locking the strut notches into the hub pins. Use the wires on the struts to secure the struts to the hub, by guiding the wires through the spaces on opposing sides of the hub and twisting the wires tight enough to prevent the strut from separating from the hub.

116th Step: Using a mallet, drive two Entry Midway Struts onto the inserts and pins of the adjacent Hexagon Hubs, on each side of the doorway. Use the wires on the struts to secure the struts to the hub, by guiding the wires through the spaces on opposing sides of the hub and twisting the wires tight enough to prevent the strut from separating from the hub.

117th Step: Using a mallet, drive two Entry Midway "T" Hubs into the Entry Top Struts and the Entry Midway Struts. Use the wires on the struts to secure the struts to the hub, by guiding the wires through the spaces on opposing sides of the hub and twisting the wires tight enough to prevent the strut from separating from the hub. The remaining insert should be pointing downward.

118th Step: Using a mallet drive the remaining two Entry Struts into the inserts of the Entry Midway "T" Hubs. Use the wires on the struts to secure the struts to the hub, by guiding the wires through the spaces on opposing sides of the hub and twisting the wires tight enough to prevent the strut from separating from the hub.

119th Step: Using a mallet, drive the two Entry Bottom Hubs into the C, B, and Entry Struts. Use the wires on the struts to secure the struts to the hub, by guiding the wires through the spaces on opposing sides of the hub and twisting the wires tight enough to prevent the strut from separating from the hub.

Form Installation on Frame.

After the frame is assembled and the concrete in the struts has cured for three days, the forms and concrete are ready to be installed over the hub connections. 1) Place a pentagon or a hexagon form under the center of the corresponding metal hub. 2) Fold the flaps around the struts. 3) Take the string over the struts and wrap around the screw on each flap securing the form to the framework. 4) When the form is in the horizontal position, secure the flaps and fill concrete from the top. 5) When the form is in the vertical position, leave the top flap untied for inserting concrete. 6) For vertical forms, place the outer part of the form with the notched side facing outward against the ends of the flaps of the attached form. 7) Secure wire around the strut below the notch in the outer part of the form. 8) Pull the wire across the notch in the form and secure the wire on an opposing strut below the end of the notch. 9) Repeat Step 8 by running the wires through the axes of the hub until all of the axes are secure. 10) Tighten the wires to bend the outer form into to the shape of an apex shape. 11) Draw the surface of the outer form to the ends of the flaps of the inner form. 12) Pour concrete mix in the upper opening of the form filling the form to the top. 13) Vibrate form to remove any voids in the pour to make a good cast. 14) After the concrete has set, snip the wires and remove the outer parts of the forms. 15) Untie the strings of the inner form, open up the flaps and remove the inner part of the form. Check for voids in the casting and repair as needed.

Coverings.

Figure 10:
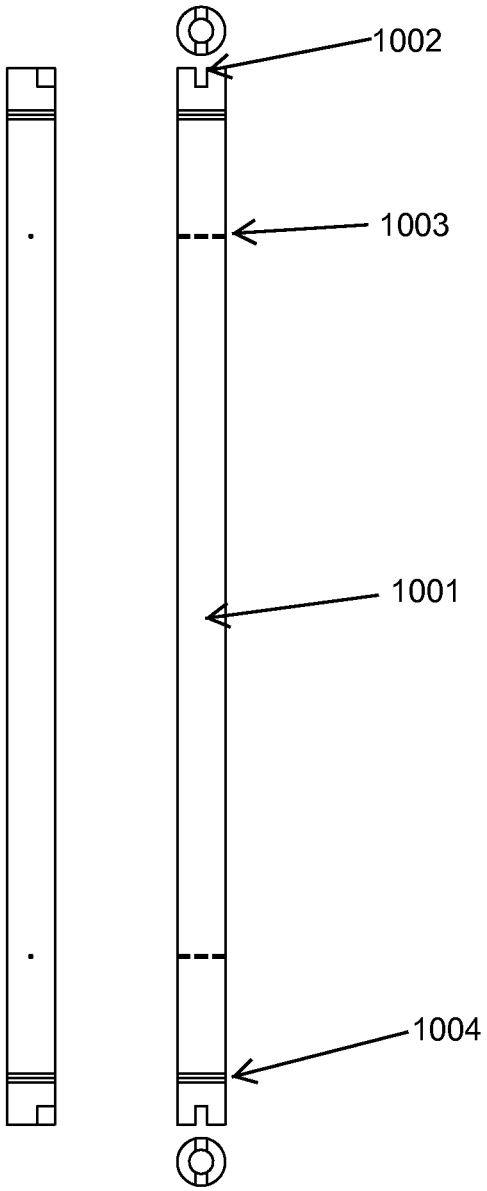
FIG. 10 illustrates a view of "B" strut.

Coverings may be utilized as shown in FIG. 17, FIG. 18, FIG. 22, and FIG. 23. An "AAB Panel" (1701) is formed of OSB panel, or any other suitable material, and cut to cover a triangular aperture created by two "A Struts" (FIG. 9) and one "B Strut" (FIG. 10). Bracing rods (1702) may be affixed to the "AAB Panel" via wire or string and bracing rod holes (1703). The "AAB Panel" may be affixed to the two "A Struts" and one "B Strut" via wire or string and "AAB Panel" holes (1704). A "CCB Panel" (1801) is formed of OSB panel, or any other suitable material, and cut to cover a triangular aperture created by two "C Struts" (FIG. 11) and one "B Strut" (FIG. 10). Bracing rods (1802) may be affixed to the "CCB Panel" via wire or string and bracing rod holes (1803). The "CCB Panel" may be affixed to the two "C Struts" and one "B Strut" via wire or string and "CCB Panel" holes (1804).

Panel Assembly.

1st Step: Place the AAB panel on the struts that form a pentagon in the middle of the dome. Locate the AAB Struts that correspond to the sides of the panel.

2nd Step: Place the AAB panel on the triangle formed by the A Struts and B Strut with the 1" bamboo braces resting on the 2" bamboo struts.

3rd Step: Wrap the panel lashing wires (attached to the panel) around the Struts and twist until panel is drawn tight against the cement hubs and 1" panel braces.

4th Step: Lock the next AAB panel into the mounted AAB panel by placing the A side over hanging 1" bamboo braces under the existing panel's A side and sliding the edges together. Line up the points of the angle's A side. Lash the panel into place drawing the panel tight against the struts and hubs.

5th Step: Continue locking and securing AAB panels into place until the last triangle in the Pentagon is to be put in place.

6th Step: Lock the next AAB panel into the mounted AAB panel by placing the A side over hanging 1" bamboo braces under the existing panel's A side and sliding the edges together. Line up the points of the angle's A side. Use a mallet to help drive the 1" bamboo braces back and forth until the panel is locked into place on both sides of the panel. Lash the panel into place drawing the panel tight against the struts and hubs.

7th Step: Place a CCB panel up against an AAB panel with the B sides lined up with each other. Place the CCB panel on the triangle formed by the C Struts and B Strut with the 1"

bamboo braces resting on the 2" bamboo struts. Lock the CCB panel into the mounted AAB panel by placing the B side over hanging 1" bamboo braces under the existing panel's B side and sliding the edges together. Line up the points of the angle's B side. Push the panel into place drawing the panel tight against the struts and hubs with the lashing wires.

8$^{th}$ Step: Lock the next CCB panel into the mounted CCB panel by placing the C side over hanging 1" bamboo braces under the existing panel's C side and sliding the edges together. Line up the points of the angle's C side. Use a mallet to help drive the 1" bamboo braces back and forth until the panel is locked into place on both sides of the panel. Lash the panel into place drawing the panel tight against the struts and hubs.

9$^{th}$ Step: Continue locking the panels together, lining up A to A sides, B to B sides and C to C sides until the dome is covered.

While the invention has been described with a certain degree of particularity, it is to be noted that modifications may be made in the details of the invention's construction and the arrangement of its components without departing from the spirit and scope of this disclosure. It is understood that the invention is not limited to the embodiments set forth herein for the purposes of exemplification.

What is claimed is:

1. A hub and strut connection for a geodesic dome structure comprising:

a. a hub with at least three prongs extending outwardly from a central point;

b. at least one locking bar interconnecting at least two of said prongs;

c. a plurality of mostly round timber or bamboo struts, wherein each strut has a first end, a second end and a middle region with at least one aperture therein between the first end and the second end, a notch in at least one of said ends, and wherein each strut has least one cavity along the longitudinal axis of said strut in at least one of said ends of said strut;

d. a coupling between said struts and said prongs of said hub which mate said prongs with said cavities of said struts and affixing with mortar or concrete deposited within said cavities of said struts and engulfing said prongs;

e. said plurality of struts anchored to said hub via wire, rope, or organic lashings;

f. an outer form of mortar or concrete encapsulating the strut and prong couplings.

* * * * *